US009833115B2

(12) United States Patent
Eriksson

(10) Patent No.: US 9,833,115 B2
(45) **Date of Patent: *Dec. 5, 2017**

(54) CLEANING NOZZLE FOR A VACUUM CLEANER

(71) Applicant: Aktiebolaget Electrolux, Stockholm (SE)

(72) Inventor: Henrik Eriksson, Stockholm (SE)

(73) Assignee: Aktiebolaget Electrolux (SE)

( * ) Notice: Subject to any disclaimer, the term of this patent is extended or adjusted under 35 U.S.C. 154(b) by 758 days.

This patent is subject to a terminal disclaimer.

(21) Appl. No.: 14/354,466

(22) PCT Filed: Oct. 26, 2012

(86) PCT No.: PCT/EP2012/071318

§ 371 (c)(1),
(2) Date: Apr. 25, 2014

(87) PCT Pub. No.: WO2013/060879

PCT Pub. Date: May 2, 2013

(65) Prior Publication Data

US 2014/0331446 A1 Nov. 13, 2014

(30) Foreign Application Priority Data

Oct. 26, 2011 (WO) ..... PCT/EP2011/068743

(51) Int. Cl.
*A47L 9/04* (2006.01)
*A46B 13/00* (2006.01)

(52) U.S. Cl.
CPC ..... *A47L 9/0477* (2013.01); *A46B 13/006* (2013.01); *A46B 2200/3033* (2013.01)

(58) Field of Classification Search
CPC ..... A47L 9/0477; A47L 9/04; A46B 13/006; A46B 2200/3033

(Continued)

(56) References Cited

U.S. PATENT DOCUMENTS 804,213 A 11/1905 Chaplin
969,441 A 9/1910 Backer (Continued)

FOREIGN PATENT DOCUMENTS

CA 2466000 5/2003
CN 1457742 11/2003

(Continued)

OTHER PUBLICATIONS

International Search Report for PCT International Application No. PCT/EP2011/068743 dated Jun. 14, 2012.

(Continued)

*Primary Examiner* — David Redding
(74) *Attorney, Agent, or Firm* — RatnerPrestia

(57) ABSTRACT

A vacuum cleaner nozzle having a rotatable member arranged around a longitudinal axis for picking up particles from a surface to be cleaned, and a cleaning arrangement for removing articles entangled on the rotatable member. The cleaning arrangement has at least one support surface provided on at least one radially projecting member of the rotatable member, and at least one cleaning member movable between a resting position in which the cleaning member is arranged at a distance from the support surface and at least one cleaning position in the vicinity of the rotatable member. In the cleaning position, the cleaning member co-operates with at least one segment of the support surface to remove any entangled articles from the rotatable member as the rotatable member rotates. The at least one support surface comprises a number of segments arranged at an individual respective radius in relation to the longitudinal axis.

22 Claims, 7 Drawing Sheets

(58) Field of Classification Search
USPC ..... 15/383
See application file for complete search history.

(56) References Cited

U.S. PATENT DOCUMENTS

| | | | |
|---|---|---|---|
| 1,231,077 | A | 6/1917 | Scheffler |
| 1,268,963 | A | 6/1918 | Gray |
| 1,412,420 | A | 4/1922 | Polansky |
| 1,757,461 | A | 5/1930 | Losey |
| 1,813,325 | A | 7/1931 | Smith |
| 1,820,350 | A | 8/1931 | Dance |
| 1,907,692 | A | 5/1933 | White |
| 1,965,614 | A | 7/1934 | Sellers |
| 1,999,696 | A | 4/1935 | Kitto |
| 2,032,345 | A | 3/1936 | Cranon |
| 2,625,698 | A | 1/1953 | De Kadt |
| 2,642,601 | A | 6/1953 | Saffioti |
| 2,642,617 | A | 6/1953 | Lilly |
| 2,663,045 | A | 12/1953 | Conway |
| 2,733,000 | A | 1/1956 | Sparklin |
| 2,741,785 | A | 4/1956 | Siebert |
| 2,789,306 | A | 4/1957 | Kath |
| 2,904,818 | A | 9/1959 | Sheahan |
| 2,960,714 | A | 11/1960 | Senne |
| 2,975,450 | A | 3/1961 | Williams |
| 3,268,936 | A | 8/1966 | Fukuba |
| 3,470,575 | A | 10/1969 | Larson |
| 3,536,977 | A | 10/1970 | Porter |
| 3,683,444 | A | 8/1972 | Schaefer |
| 3,722,018 | A | 3/1973 | Fisher |
| 3,862,467 | A | 1/1975 | Krickovich |
| 3,863,285 | A | 2/1975 | Hukuba |
| 3,928,884 | A | 12/1975 | Sutter |
| 4,020,526 | A | 5/1977 | Johansson |
| 4,084,283 | A | 4/1978 | Rosendall |
| 4,171,554 | A | 10/1979 | Tschudy |
| 4,173,054 | A | 11/1979 | Ando |
| 4,193,710 | A | 3/1980 | Pietrowski |
| 4,209,872 | A | 7/1980 | Maier |
| 4,317,253 | A | 3/1982 | Gut |
| 4,352,221 | A | 10/1982 | Revells |
| 4,370,690 | A | 1/1983 | Baker |
| 4,370,777 | A | 2/1983 | Woerwag |
| 4,372,004 | A | 2/1983 | Vermillion |
| 4,373,228 | A | 2/1983 | Dyson |
| 4,398,231 | A | 8/1983 | Currence |
| 4,426,751 | A | 1/1984 | Nordeen |
| 4,573,235 | A | 3/1986 | Baird, Sr. |
| 4,654,924 | A | 4/1987 | Getz |
| 4,702,122 | A | 10/1987 | Richard |
| 4,802,254 | A | 2/1989 | Lahndorff |
| 4,847,944 | A | 7/1989 | Lackner |
| 4,875,246 | A | 10/1989 | MacGregor |
| 4,920,605 | A | 5/1990 | Takashima |
| 4,953,253 | A | 9/1990 | Fukuda |
| 4,989,293 | A | 2/1991 | Bashyam |
| 5,075,922 | A | 12/1991 | Tsuchida |
| 5,115,538 | A | 5/1992 | Cochran |
| 5,121,592 | A | 6/1992 | Jertson |
| 5,203,047 | A | 4/1993 | Lynn |
| 5,243,732 | A | 9/1993 | Koharagi |
| 5,287,581 | A | 2/1994 | Lo |
| 5,394,588 | A | 3/1995 | Kweon |
| 5,452,490 | A | 9/1995 | Brundula |
| 5,482,562 | A | 1/1996 | Abernathy |
| 5,657,503 | A | 8/1997 | Caruso |
| 5,657,504 | A | 8/1997 | Khoury |
| 5,698,957 | A | 12/1997 | Sowada |
| 5,974,975 | A | 11/1999 | Seefried |
| 6,042,656 | A | 3/2000 | Knutson |
| 6,123,779 | A | 9/2000 | Conrad |
| 6,131,238 | A | 10/2000 | Weber |
| 6,170,119 | B1 | 1/2001 | Conrad |
| 6,253,414 | B1 | 7/2001 | Bradd |
| 6,266,838 | B1 | 7/2001 | Caruso |
| 6,282,749 | B1 | 9/2001 | Tajima |
| 6,286,180 | B1 | 9/2001 | Kasper |
| 6,289,552 | B1 | 9/2001 | McCormick |
| 6,351,872 | B1 | 3/2002 | McCormick |
| 6,367,120 | B2 | 4/2002 | Beauchamp |
| 6,502,277 | B1 | 1/2003 | Petersson |
| 6,539,575 | B1 | 4/2003 | Cohen |
| 6,539,577 | B1 | 4/2003 | Okuda |
| 6,605,156 | B1 | 8/2003 | Clark |
| 6,810,559 | B2 | 11/2004 | Mertes |
| 6,883,201 | B2 | 4/2005 | Jones |
| 6,892,420 | B1 | 5/2005 | Haan |
| 7,143,461 | B2 | 12/2006 | Spooner |
| 7,159,276 | B2 | 1/2007 | Omoto |
| 7,163,568 | B2 | 1/2007 | Sepke |
| 7,171,723 | B2 | 2/2007 | Kobayashi |
| 7,228,593 | B2 | 6/2007 | Conrad |
| 7,237,298 | B2 | 7/2007 | Reindle |
| 7,243,393 | B2 | 7/2007 | Matusz |
| 7,293,326 | B2 | 11/2007 | Hawkins |
| 7,627,927 | B2 | 12/2009 | Blocker |
| 7,631,392 | B1 | 12/2009 | Meitz |
| 7,731,618 | B2 | 6/2010 | Burlington |
| 8,087,117 | B2 | 1/2012 | Kapoor |
| 8,418,303 | B2 | 4/2013 | Kapoor |
| 8,567,009 | B2 | 10/2013 | Krebs |
| 8,601,643 | B2 | 12/2013 | Eriksson |
| 8,671,515 | B2 | 3/2014 | Eriksson |
| 9,072,416 | B2 | 7/2015 | Kowalski |
| 9,186,030 | B2 | 11/2015 | Jung |
| 9,314,140 | B2 | 4/2016 | Eriksson |
| 2002/0007528 | A1 | 1/2002 | Beauchamp |
| 2004/0172769 | A1 | 9/2004 | Giddings |
| 2004/0181888 | A1 | 9/2004 | Tawara |
| 2004/0244140 | A1 | 12/2004 | Joo |
| 2005/0015916 | A1 | 1/2005 | Orubor |
| 2005/0015922 | A1 | 1/2005 | Lim |
| 2005/0091788 | A1 | 5/2005 | Forsberg |
| 2006/0000053 | A1 | 1/2006 | Lim |
| 2006/0037170 | A1 | 2/2006 | Shimizu |
| 2006/0162121 | A1 | 7/2006 | Naito |
| 2006/0272122 | A1 | 12/2006 | Butler |
| 2006/0288517 | A1 | 12/2006 | Oh |
| 2007/0079474 | A1 | 4/2007 | Min |
| 2008/0052846 | A1 | 3/2008 | Kapoor |
| 2008/0289141 | A1 | 11/2008 | Oh |
| 2009/0000057 | A1 | 1/2009 | Yoo |
| 2009/0100636 | A1 | 4/2009 | Sohn |
| 2009/0229075 | A1 | 9/2009 | Eriksson |
| 2010/0107359 | A1 | 5/2010 | Yoo |
| 2010/0205768 | A1 | 8/2010 | Oh |
| 2010/0287717 | A1 | 11/2010 | Jang |
| 2010/0313912 | A1 | 12/2010 | Han et al. |
| 2011/0035900 | A1 | 2/2011 | Chae |
| 2012/0013907 | A1 | 1/2012 | Jung |
| 2012/0124769 | A1 | 5/2012 | Krebs |
| 2013/0007982 | A1 | 1/2013 | Yun |
| 2013/0008469 | A1 | 1/2013 | Yun |
| 2013/0042429 | A1 | 2/2013 | Misumi |
| 2013/0055522 | A1 | 3/2013 | Hawkins |
| 2013/0192021 | A1 | 8/2013 | Eriksson |
| 2013/0192022 | A1 | 8/2013 | Eriksson |
| 2013/0192023 | A1 | 8/2013 | Eriksson |
| 2013/0192024 | A1 | 8/2013 | Eriksson |
| 2013/0198995 | A1 | 8/2013 | Eriksson |
| 2014/0259521 | A1 | 9/2014 | Kowalski |
| 2014/0304941 | A1 | 10/2014 | Eriksson |
| 2014/0331446 | A1 | 11/2014 | Eriksson |
| 2014/0352104 | A1 | 12/2014 | Eriksson |
| 2014/0359968 | A1 | 12/2014 | Eriksson |
| 2014/0366300 | A1 | 12/2014 | Eriksson |
| 2016/0015233 | A1 | 1/2016 | Uphoff |

FOREIGN PATENT DOCUMENTS

| | | |
|---|---|---|
| CN | 1593320 | 3/2005 |
| CN | 2746989 | 12/2005 |
| CN | 1816300 | 8/2006 |
| CN | 1816301 | 9/2006 |

(56) References Cited

FOREIGN PATENT DOCUMENTS

| | | |
|---|---|---|
| CN | 1883354 | 12/2006 |
| CN | 101310666 | 11/2008 |
| CN | 101686783 | 3/2010 |
| CN | 101984742 | 3/2011 |
| CN | 102334943 | 2/2012 |
| CN | 102462450 | 5/2012 |
| DE | 102010017211 | 12/2011 |
| DE | 102010017258 | 12/2011 |
| EP | 0649625 | 9/1994 |
| EP | 1415583 | 5/2004 |
| EP | 1442693 | 8/2004 |
| EP | 1642520 | 4/2006 |
| EP | 1994869 | 11/2008 |
| EP | 2253258 | 11/2010 |
| EP | 2273906 | 1/2011 |
| EP | 2543301 | 1/2013 |
| FR | 1068296 | 6/1954 |
| FR | 2855742 | 12/2004 |
| GB | 2000963 | 6/1978 |
| GB | 2231778 | 11/1990 |
| JP | 4944560 | 4/1974 |
| JP | 50114057 | 9/1975 |
| JP | 61062426 | 3/1986 |
| JP | 05095868 | 4/1993 |
| JP | 05103740 | 4/1993 |
| JP | 405095868 | 4/1993 |
| JP | 405305044 | 11/1993 |
| JP | 0686743 | 3/1994 |
| JP | 06086743 | 3/1994 |
| JP | 0856877 | 3/1996 |
| JP | 08056877 | 3/1996 |
| JP | 08289862 | 11/1996 |
| JP | 2002165731 | 6/2002 |
| JP | 2003047577 | 2/2003 |
| JP | 2003125991 | 5/2003 |
| JP | 2005160578 | 6/2005 |
| JP | 2005211426 | 8/2005 |
| JP | 2008000382 | 1/2008 |
| JP | 2008188319 | 8/2008 |
| JP | 2008278947 | 11/2008 |
| JP | 2009022644 A | 2/2009 |
| WO | WO92/10967 | 7/1992 |
| WO | 2008099583 | 8/2008 |
| WO | 2009117383 | 9/2009 |
| WO | WO 2009/117383 | 9/2009 |
| WO | 2010041184 | 4/2010 |
| WO | 2013060365 | 5/2013 |
| WO | 2013060880 | 5/2013 |
| WO | 2013113395 | 8/2013 |
| WO | 2014094869 | 6/2014 |
| WO | 2014177216 | 11/2014 |

OTHER PUBLICATIONS

International Search Report for PCT International Application No. PCT/EP2012/051773 dated Sep. 17, 2012.
International Search Report for PCT International Application No. PCT/EP2012/071319 dated Dec. 11, 2012.
Office Action (with English translation)for Chinese Patent Application No. 200980110915.5 dated Feb. 4, 2013.
Search Report and Written Opinion for PCT International Application No. PCT/US2009/037348 dated May 14, 2009.
Supplemental European Search Report for International Application No. EP09721677 dated Oct. 30, 2012.
Entire patent prosecution history of U.S. Appl. No. 14/374,119, filed Aug. 25, 2014, entitled, "Cleaning Arrangement for a Nozzle of a Vacuum Cleaner."
Entire patent prosecution history of U.S. Appl. No. 12/405,761, filed Mar. 17, 2009, entitled, "Agitator With Cleaning Features," now U.S. Pat. No. 8,601,643, issued Dec. 10, 2013.
Entire patent prosecution history of U.S. Appl. No. 13/826,400, filed Mar. 14, 2013, entitled, "Brushroll Cleaning Feature With Resilient Linkage to Regulate User-Applied Force," now U.S. Pat. No. 8,671,515, issued Mar. 18, 2014.
Entire patent prosecution history of U.S. Appl. No. 13/826,630, filed Mar. 14, 2013, entitled, "Brushroll Cleaning Feature With Spaced Brushes and Friction Surfaces to Prevent Contact."
Entire patent prosecution history of U.S. Appl. No. 13/826,855, filed Mar. 14, 2013, entitled, "Brushroll Cleaning Feature With Overload Protection During Cleaning."
Entire patent prosecution history of U.S. Appl. No. 13/826,934, filed Mar. 14, 2013, entitled, "Automated Brushroll Cleaning."
Entire patent prosecution history of U.S. Appl. No. 13/835,691, filed Mar. 15, 2013, entitled, "Vacuum Cleaner Agitator Cleaner With Power Control."
Entire patent prosecution history of U.S. Appl. No. 13/838,035, filed Mar. 15, 2013, entitled, "Vacuum Cleaner Agitator Cleaner With Brushroll Lifting Mechanism."
Entire patent prosecution history of U.S. Appl. No. 14/354,449, filed Apr. 25, 2014, entitled, "Cleaning Nozzle for a Vacuum Cleaner."
Entire patent prosecution history of U.S. Appl. No. 14/354,460, filed Jun. 19, 2014, entitled, "Cleaning Nozzle for a Vacuum Cleaner."
Entire patent prosecution history of U.S. Appl. No. 14/462,956, filed Aug. 19, 2014, entitled, "Vacuum Cleaner Brushroll Cleaner Configuration."
Entire patent prosecution history of U.S. Appl. No. 14/467,697, filed Aug. 25, 2014, entitled, "Actuator Mechanism for a Brushroll Cleaner."
International Search Report and Written Opinion for International Application No. PCT/IB2014/001050, dated Oct. 28, 2014.
International Search Report and Written Opinion for International Application No. PCT/IB2014/001256, dated Oct. 28, 2014.
International Search Report for International Application No. PCT/EP2012/076620 dated Jul. 23, 2013.
Non-Final Office Action dated Apr. 16, 2015 for U.S. Appl. No. 14/354,460.
Notice of Allowance dated Apr. 24, 2015 for U.S. Appl. No. 13/838,035.
Entire patent prosecution history of U.S. Appl. No. 14/702,034, filed May 1, 2015, entitled, "Cleaning Nozzle for a Vacuum Cleaner."
Entire patent prosecution history of U.S. Appl. No. 14/651,059, filed Jun. 10, 2015, entitled, "Cleaning Arrangement for a Rotatable Member of a Vacuum Cleaner, Cleaner Nozzle, Vacuum Cleaner and Cleaning Unit."
Office Action dated May 20, 2015 for U.S. Appl. No. 13/835,691.
Entire patent prosecution history of U.S. Appl. No. 14/730,833, filed Jun. 4, 2015, entitled, "Vacuum Cleaner Agitator Cleaner With Agitator Lifting Mechanism."
Notice of Allowance dated Jun. 24, 2015 for U.S. Appl. No. 13/826,855.
Office Action dated Jul. 7, 2015 for U.S. Appl. No. 13/826,934.
International Search Report for PCT International Application No. PCT/EP2012/071318 dated Jan. 3, 2013.
Notice of Allowance dated Dec. 23, 2015 for U.S. Appl. No. 14/354,460.
Notice of Allowance dated Dec. 31, 2015 for U.S. Appl. No. 13/826,630.
Notice of Allowance dated Dec. 15, 2015 for U.S. Appl. No. 13/835,691.
Final Office Action dated Nov. 30, 2015 for U.S. Appl. No. 13/826,934.
International Search Report dated Dec. 10, 2013 for International Application No. PCT/EP2013/059148.
International Search Report and Written Opinion for International Application No. PCT/IB2015/001873, dated Feb. 4, 2016.
Notice of Allowance dated Feb. 11, 2016 for U.S. Appl. No. 13/826,934.
Japanese Office Action dated Dec. 15, 2015 for Japanese Application No. 2014-555092 with translation.
Chinese Office Action dated Nov. 27, 2015 for Chinese Application No. 201280068532.8 with translation.
Chinese Office Action dated Feb. 29, 2016 for Chinese Application No. 201310485330.X with translation. (pp. 1-9).
Non Final Office Action for U.S. Appl. No. 14/730,833, dated May 19, 2016. (pp. 1-31).
Chinese Office Action dated Apr. 1, 2016 for Chinese Application No. 201280076273.3 with translation. (pp. 1-17).

(56) References Cited

OTHER PUBLICATIONS

Chinese Office Action for Chinese Application No. 201310485447.8, dated Feb. 14, 2015 with translation. (pp. 1-5).
Non Final Office Action for U.S. Appl. No. 14/354,449, dated Aug. 11, 2016, 45 pages.
Japanese Office Action for Japanese Application No. 2014-537645, dated Jun. 14, 2016 with translation, 5 pages.
Japanese Office Action for Japanese Application No. 2014-555092, dated May 24, 2016 with translation, 5 pages.
Notice of Allowance for U.S. Appl. No. 14/354,449, dated Nov. 30, 2016, 10 pages.
Non Final Office Action for U.S. Appl. No. 14/888,275, dated Dec. 2, 2016, 24 pages.
Notice of Allowance for U.S. Appl. No. 14/730,833, dated Dec. 2, 2016, 14 pages.
Japanese Office Action for Japanese Application No. 2015548227, dated Oct. 14, 2016, 5 pages.
Chinese Office Action for Application No. 201280058003.X, dated Oct. 9, 2016, 18 pages.
Chinese Office Action dated Jul. 1, 2015 for Chinese Application No. 201310485330.X, including English language translation.
Chinese Office Action dated Jul. 14, 2015 for Chinese Application No. 201310479507.5, including English language translation.
Chinese Office Action dated Jul. 3, 2015 for Chinese Application No. 201310485943.3, including English language translation.
Chinese Office Action dated Jun. 30, 2015 for Chinese Application No. 201310485447.8, including English language translation.
International Preliminary Report on Patentability for International Application No. PCT/IB2014/001050 dated Sep. 15, 2015.
International Preliminary Report on Patentability for International Application No. PCT/IB2014/001256 dated Sep. 15, 2015.
Notice of Allowance dated Sep. 10, 2015 for U.S. Appl. No. 13/826,630.
Notice of Allowance dated Oct. 9, 2015 for U.S. Appl. No. 14/354,460.
Notice of Allowance dated Oct. 16, 2015 for U.S. Appl. No. 13/835,691.
International Preliminary Report on Patentability for International Application No. PCT/IB2015/001873, dated Febraury 28, 2017, 3 pages.
Non Final Office Action for U.S. Appl. No. 14/467,697, dated Feb. 13, 2017, 17 pages.
Non Final Office Action for U.S. Appl. No. 14/462,956, dated Feb. 22, 2017, 13 pages.
Chinese Office Action for Application No. 201280058003.X, dated Apr. 6, 2017 with translation, 17 pages.
Korean Office Action for Korean Application No. 10-2014-7013892, dated Jun. 30, 2017 with translation, 16 pages.
Notice of Allowance for U.S. Appl. No. 14/354,449, dated Augsut 11, 2017, 9 pages.
Notice of Allowance for U.S. Appl. No. 14/462,956, dated Jul. 19, 2017, 10 pages.
Notice of Allowance for U.S. Appl. No. 14/467,697, dated Jun. 30, 2017, 11 pages.
Non Final Office Action for U.S. Appl. No. 14/374,119, dated Jun. 27, 2017, 8 pages.
Non Final Office Action for U.S. Appl. No. 14/651,059, dated Jul. 17, 2017, 8 pages.
Non Final Office Action for U.S. Appl. No. 14/702,034, dated Oct. 16, 2017, 11 pages.

CLEANING NOZZLE FOR A VACUUM CLEANER

This application is a National Stage Application of International Application No. PCT/EP2012/071318, filed Oct. 26, 2012, which claims priority to International Application No. PCT/EP2011/068743, filed Oct. 26, 2011, the entire disclosures of which are expressly incorporated by reference herein.

TECHNICAL FIELD

The present invention relates to a nozzle for a vacuum cleaner comprising a rotatable member and a cleaning arrangement for removing articles entangled to the rotatable member. The invention is intended for battery powered vacuum cleaners as well as mains-operated vacuum cleaners. The nozzle according to the present invention is further envisaged for robotic vacuum cleaners.

BACKGROUND OF THE INVENTION

In vacuum cleaning nozzles provided with a rotatable member, i.e. a rotatable brush roll, it is known that threads, lint, human or animal hairs or any other fibrous material tend to cling or wrap around adhere to the brush roll during operation of the vacuum cleaner. This may impair the functioning of the cleaning nozzle.

In WO2009/117383A2 it is disclosed a cleaning nozzle for a vacuum cleaner provided with a rotary brush having projecting friction surfaces and one or more cleaning members for removing debris that has been wrapped around the rotary brush. The cleaning members are positioned adjacent the rotary brush and are adapted to move between a resting position and a cleaning position, and are arranged to clean the rotary brush during rotation of the brush. Debris that has been collected on a rotary brush is often difficult to remove because it has wrapped tightly around the brush roll and intertwined the bristles. Therefore, a significant force is needed to be able to thread off the entangled threads by means of a cleaning member pressing against a friction member. Such a force may be applied manually by a user of the vacuum cleaner. The electrical vacuum cleaner or motor brush head need to be capable of providing the necessary power to obtain rotation of the brush roll when such force is applied.

A drawback with the disclosed design is that contact between the cleaning member and the friction member of the brush roll occurs at multiple positions at any given brush roll orientation, which may deteriorate performance of normal cleaning operation when the brush roll is subject to a cleaning action.

SUMMARY OF THE INVENTION

An object of the present invention is to overcome at least one of the above mentioned drawback relating to multiple contact positions between the brush roll friction member and the cleaning member.

According to an aspect of the invention a nozzle for a vacuum cleaner is provided. The nozzle comprises a rotatable member for picking up particles from a surface to be cleaned. The rotatable member is arranged around a longitudinal axis. The nozzle further comprises a cleaning arrangement for removing articles entangled to the rotatable member. The cleaning arrangement comprises at least one support surface provided on at least one radially projecting member of the rotatable member, and at least one cleaning member being movable between a resting position in which the cleaning member is arranged at a distance from the support surface and at least one cleaning position in the vicinity of the rotatable member in which the cleaning member, during rotation of the rotatable member, co-operates with at least one segment of the support surface to remove any entangled articles from the rotatable member. Further, the at least one support surface comprises a plurality of segments, each of the segments being arranged at an individual radius in relation to the longitudinal axis.

Thus, at least one support surface comprising a plurality of segments where each of the segments is arranged at an individual radius in relation to the longitudinal axis. By choosing proper radius of the segments, the cleaning member will be in contact with a limited area of the support surface. Contact in a limited area such as a single point ensure efficient cleaning while still not disturbing normal cleaning operation. Further, by obtaining a limited area of support surface contact with the cleaning member, such as in a single point, the necessary power to obtain rotation of a rotatable member, such as a brush roll, is limited compared to earlier solutions.

In an embodiment of the present invention, the cleaning member comprises a resilient sheet member capable of providing a resilient contact with at least one segment of the at least one support surface in the at least one cleaning position during rotation of the rotatable member.

By providing resilient contact for a cleaning action, the necessary power to obtain rotation of a rotatable member, such as a brush roll, is limited compared to earlier solutions.

Thereby, proper cleaning function is ensured during cleaning action. Further, by choosing proper radius of the segments of the at least one support surface, the resilient sheet member of the cleaning member will be in resilient contact with a limited area of the support surface. Contact in a limited area such as a single point ensure efficient cleaning while still not disturbing normal cleaning operation.

According to another aspect of the invention, a vacuum cleaner provided with such a nozzle is provided.

In embodiments, the radius of the segments is gradually changed whereby the segments form a continuous support surface.

In embodiments, a plurality of support surfaces is arranged on a plurality of radially projecting members.

In embodiments, the cleaning member comprises a longitudinal bar holding the resilient sheet member. The longitudinal bar is arranged along a longitudinal axis of the rotatable member.

In embodiments, the resilient sheet member of the cleaning member in the at least one cleaning position meets a tangent of the at least one segment of the at least one support surface at an angle $\alpha$ which is in the range of 40°-90°. The angle is chosen to enable efficient cleaning but still enable rotational movement of the rotatable member of the nozzle to ensure proper cleaning function during cleaning operation.

In embodiments, the resilient sheet member has a thickness in the range of 0.2-0.8 mm.

In embodiments, the at least one radially projecting member is helically arranged along a longitudinal axis of the rotatable member. The helical arrangement ensures proper cleaning of the rotatable member during rotation while at the same time the cleaning interaction is performed within a limited support surface. Thereby, the impact on the rotational speed of the rotatable member is reduced and an effective cleaning action is performed while at the same time normal cleaning operation is maintained.

In embodiments, one single radially projecting member is helically arranged along a longitudinal axis of the rotatable member.

In embodiments, a plurality of radially projecting members is helically arranged along a longitudinal axis of the rotatable member.

In embodiments, the cleaning member is pivotally arranged via the longitudinal bar above the rotatable member such that the cleaning member is pivoted from the resting position above the rotatable member to the at least one cleaning position.

In embodiments, the cleaning member is moved from the resting position to the at least one cleaning position by applying a pressing force to a push button provided on the nozzle at a surface turned towards a user.

In embodiments, the cleaning member is connected via a linking mechanism shaft to the push button on the nozzle.

In embodiments, at least one protruding part is arranged on the nozzle at a surface turned towards the surface to be cleaned. When a cleaning action is performed, the protruding part prevents the nozzle from tilting due to the force applied on it.

In embodiments, the rotatable member comprises radial ribs arranged perpendicular to the longitudinal axis of the rotatable member.

In embodiments, the radial ribs extend from the rotatable member to the at least one projecting member creating multiple pockets along the rotatable member. The multiple pockets hinder entangled articles from wandering towards the middle segment of the rotatable member. Thereby, entangled articles are distributed along the length of the rotatable member. Even distribution of the entangled articles is advantageous because the layers of entanglement will be fewer. Fewer revolutions of the rotatable member will then be needed for proper cleaning. The total cleaning time is thereby reduced.

In embodiments, a plurality of support surfaces is arranged on a plurality of radially projecting members.

In embodiments, the nozzle further comprises a nozzle cover that at least partly is made of transparent material such that the rotatable member may be visible through the nozzle cover. Thereby, the user is able to see if there are a lot of entangled articles present requiring a cleaning action to be performed.

Further features of, and advantages with, the present invention will become apparent when studying the appended claims and the following description. Disclosed features of example embodiments may be combined to create embodiments other than those described in the following as readily understood by one of ordinary skill in the art to which this invention belongs, without departing from the scope of the present invention, as defined by the appended claims.

BRIEF DESCRIPTION OF THE DRAWINGS

The various aspects of the invention, including its particular features and advantages, will be readily understood from the following detailed description and the accompanying drawings, in which.

DETAILED DESCRIPTION OF PREFERRED EMBODIMENTS

Figure 1:
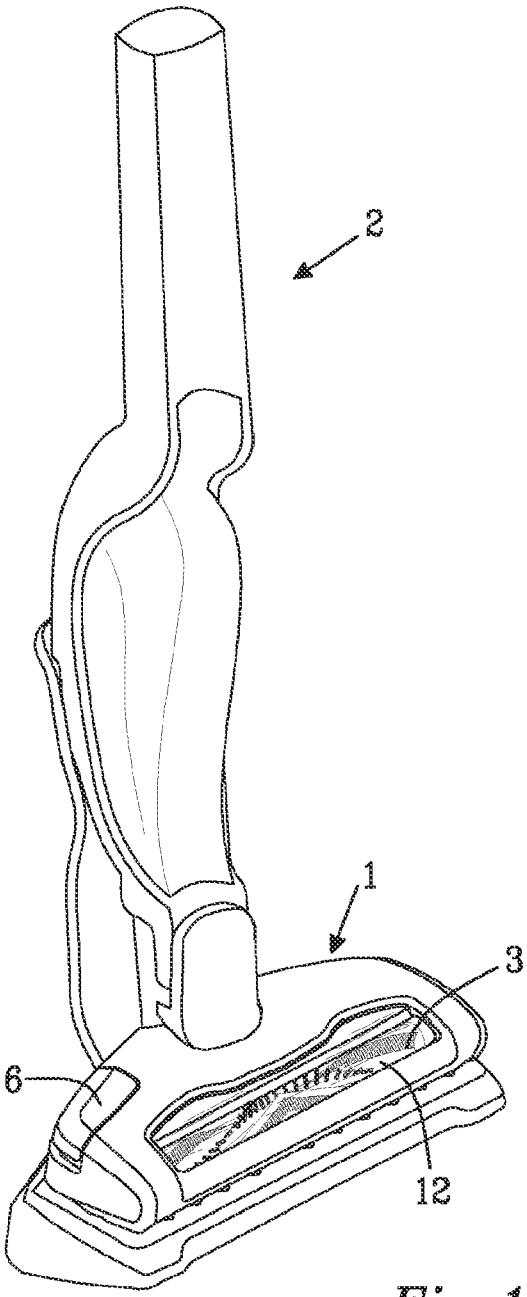
FIG. 1 illustrates a vacuum cleaner according to an embodiment.

The present invention will now be described more fully with reference to the accompanying drawings, in which example embodiments are shown. However, this invention should not be construed as limited to the embodiments set forth herein. Throughout the following description similar reference numerals have been used to denote similar elements, parts, items or features, when applicable.

FIG. 1 illustrates a vacuum cleaner 2 of an upright model comprising a nozzle 1 provided with a rotatable member 3, like a brush roll, for picking up particles from a surface to be cleaned. The nozzle 1 is further provided with a cleaning arrangement for removing articles entangled to the rotatable member 3. The nozzle 1 comprises a cover 12 that at least partly is made of transparent material such that the rotatable member 3 may be visible through the nozzle cover 12. Thereby, the user is able to see if there are a lot of articles like hair entangled to the rotatable member 3. The user initiates cleaning of the rotatable member 3 by pushing a push button 6 on the nozzle 1.

Figure 2:
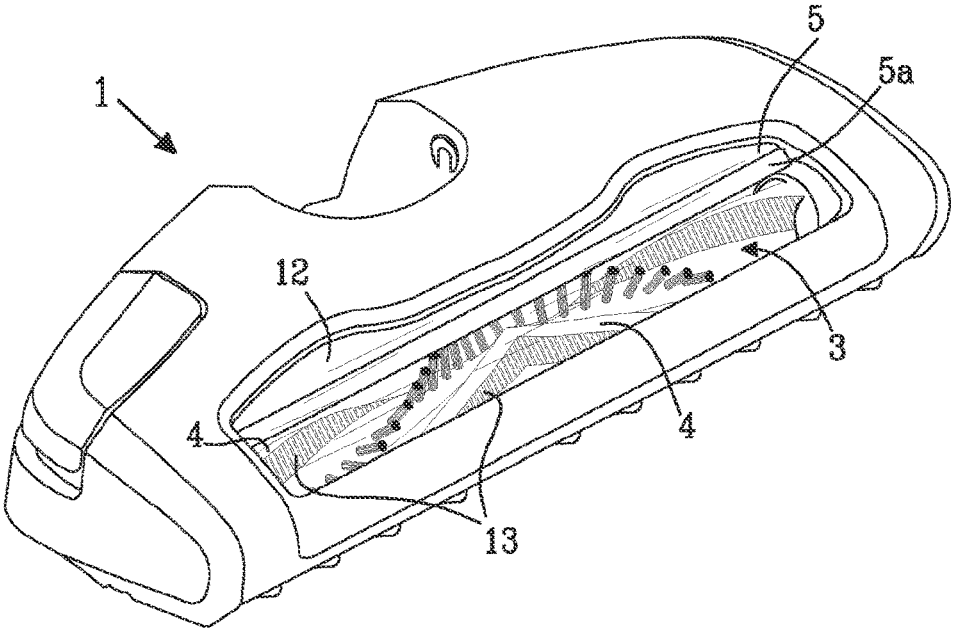
FIG. 2 illustrates a nozzle with a brush roll comprising a projecting cleaning surface in more detail.

FIG. 2 shows a nozzle 1 in more detail. The cleaning arrangement comprises a cleaning member 5 and a support surface 4 provided on a radially projecting member 13 of the rotatable member 3. In the embodiment shown, two projecting members 13 are helically arranged along a longitudinal axis of the rotatable member 3. Other possible alternatives may be a single helically arranged projecting member 13, or more than two helically arranged projecting members 13. The cleaning member 5 is movable between a resting position in which the cleaning member 5 is arranged at a distance from the support surface 4 and a cleaning position. The cleaning position may be arranged stepwise or gradually, thus enabling the cleaning member 5 to approach the support surface during cleaning action. This might be advantageous for example if a thick layer of entangled articles are present, or if the power available for driving the rotatable member 3 is limited. A push button 6, connected via a linking mechanism 7 shaft to a cleaning member 5, is provided to move the cleaning member 5 between the resting position and the cleaning position.

In a cleaning position, a resilient sheet member 5*a* of the cleaning member 5 co-operates with the support surface 4 during rotation of the rotatable member 3 to remove any entangled articles from the rotatable member 3. The resilient sheet member 5*a* is capable of providing a resilient contact with the support surface 4 in the cleaning position during rotation of the rotatable member 3. Thereby, the possible slow down of the rotational speed of the rotatable member 3 due to the cleaning action will be limited if there is a lot of entangled articles to be removed. The nozzle 1 comprises a cover 12 that at least partly is made of transparent material such that the rotatable member 3 may be visible through the nozzle cover 12. The transparency enables a user to see if a cleaning action is needed or not.

Figure 3:
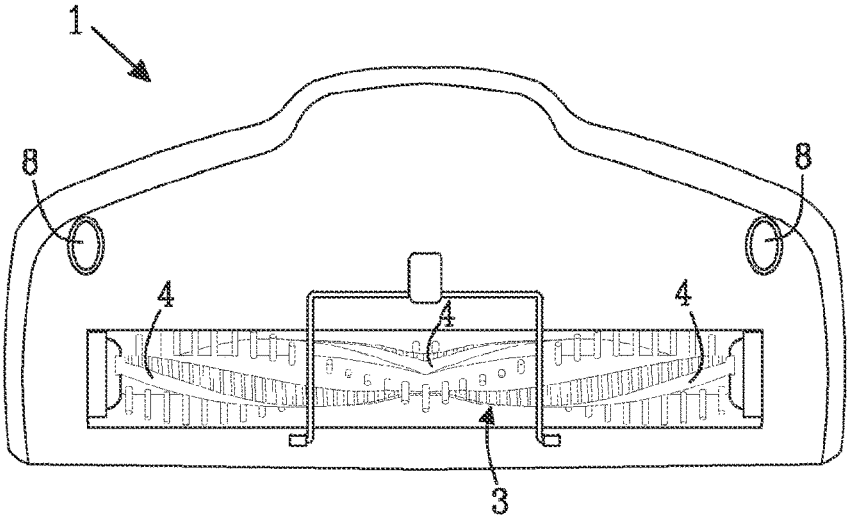
FIG. 3 illustrates the nozzle from underneath.

FIG. 3 illustrates the nozzle 1 from underneath. When the push button 6 is pressed down, the nozzle 1 is prevented from tilting by one or more protruding parts 8 provided underneath the nozzle 1. The protruding part (-s) 8 is arranged on the nozzle 1 at a surface turned towards the surface to be cleaned.

Figure 4A:
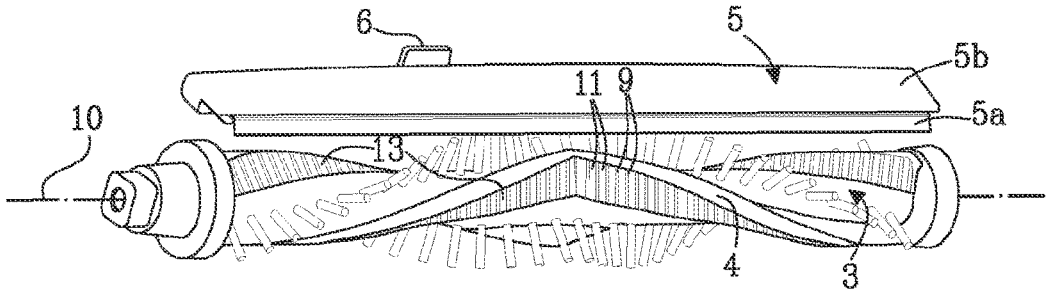
FIGS. 4*a-d* illustrate a cleaning arrangement for the brush roll of the nozzle according to embodiments.
Figure 4B:
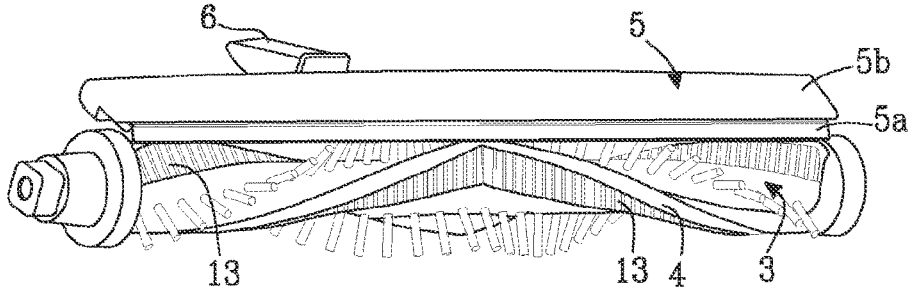

FIGS. 4*a-b* illustrate a resting mode and a second cleaning mode of the cleaning arrangement for a brush roll of the nozzle. The cleaning member 5 is pivotally arranged via a longitudinal bar 5*b* above the rotatable member 3 such that the cleaning member 5 is pivoted from the resting position above the rotatable member 3 to a cleaning position adjacent the support surface. The length of the cleaning member 5 is preferably the same as the length of the brush roll that is covered by the support surface 4. Two radially projecting members 13 are helically arranged along a longitudinal axis 10 of the rotatable member 3. The cleaning member 5 comprises a longitudinal bar 5*b* holding a resilient sheet member 5*a*. The cleaning member 5 is arranged along a longitudinal axis 10 of the rotatable member 3. The resilient sheet member 5*a* has preferably a thickness in the range of 0.2-0.8 mm. It is of importance to choose a suited material for the resilient sheet member 5*a*. The material will, over time, get worn and loose its original tearing ability. To be wear resistant relatively hard spring steel may be used. The edge of the cleaning member 5 that will be in contact with the support surface need to be relatively sharp in order to effectively remove entangled articles. By shearing, or punch pressing the spring steel, one of the edges of the sheared surface will be rounded while the other will have an edge burr. By punch pressing the cleaning member 5 one edge of the cut surface will be sharper than the other. By shearing, or punch pressing, there will be as mentioned above, an edge burr at the cleaning member 5 edge. If the edge burr is minimized this will create a sharp edge suited for cleaning entangled articles from the brush roll. As an alternative to the above mentioned edge burr, the edge of the cleaning member 5 may be sharpened by machining. Thereby, improved tolerance of the sharp edge is achieved.

Figure 4C:
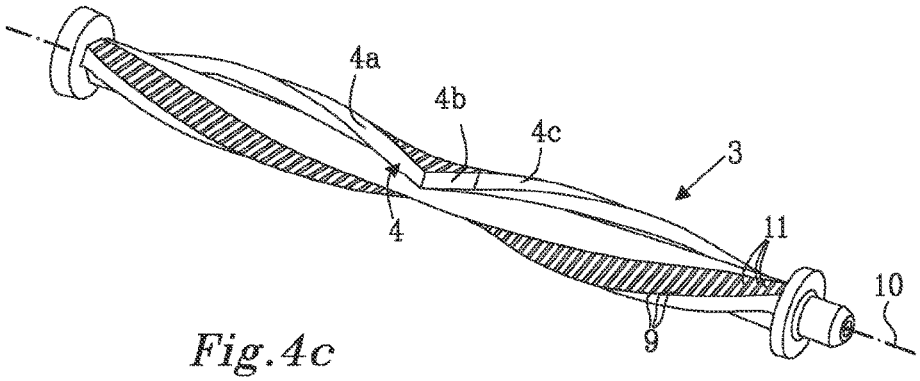

FIG. 4*c* illustrates a rotatable member 3 shown as a brush roll provided with a support surface 4 which in an embodiment of the present invention comprises a plurality of segments 4*a*, 4*b*, 4*c*. Each of the segments 4*a*, 4*b*, 4*c* are arranged at an individual radius in relation to the longitudinal axis 10. The radius of the segments is in the shown embodiment gradually changed whereby the segments form a continuous support surface 4. Alternatively, the radius may be changed in steps whereby three separate support surfaces with different radius are provided. The radius of the segment 4*a* is chosen to enable cleaning contact between the cleaning member, when in a cleaning position, and the surface segment 4*a*. The radius of the segment 4*c* is chosen to enable a small distance between the cleaning member 5, when the cleaning member 5 is in cleaning position, and the segment 4*c*. The segment 4*b* is provided with a gradually changing radius providing a smooth transition from the radius of segment 4*a* to the radius of segment 4*c*.

Figure 4D:
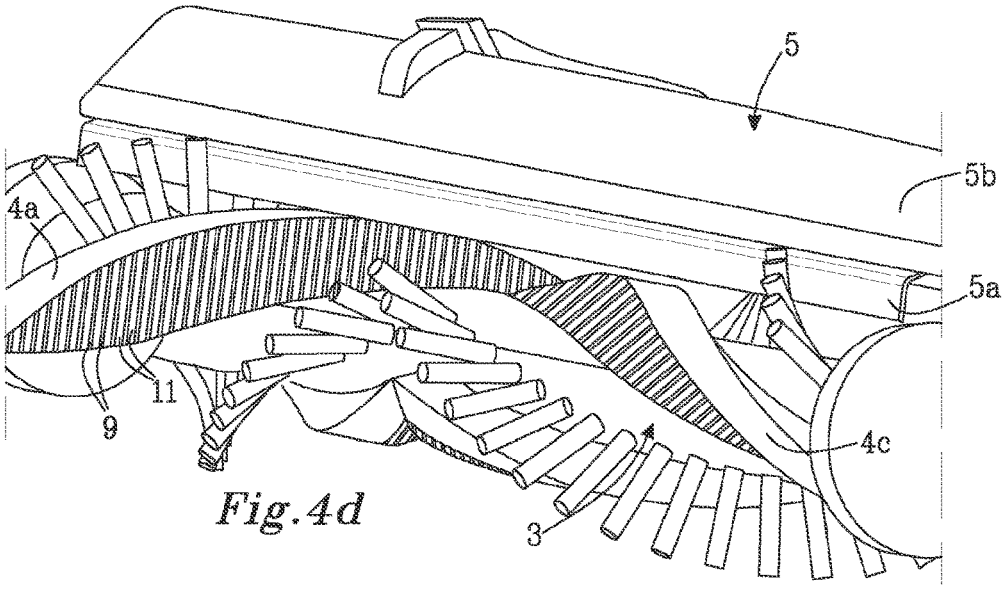

In FIG. 4*d* the cleaning member 5 is seen during cleaning of the rotatable member 3 of FIG. 4*c*. The resilient sheet member 5*a* of the cleaning member 5 will be in resilient contact with the support surface in a single contact point at segment 4*a*. If the resilient sheet member 5*a* is enabled to flex enough, a certain amount of contact may also be achieved at segment 4*c*. However, although some cleaning interaction may be performed at segment 4*c*, the majority of force applied to the cleaning member will be transferred to segment 4*a*. By such an arrangement, at least the most part of the force applied to the cleaning member 5 is focused to the contact with segment 4*a*. Contact in a single point, or at least in a limited area, ensure efficient cleaning while still not disturbing the normal cleaning operation.

A problem during cleaning of the brush roll is that entanglement around the brush roll seems not to be evenly spread along the length of the brush roll. Instead, entanglement is of greatest magnitude in the middle segment of the brush roll. Such uneven distribution of the entangled articles is disadvantageous from a brush roll cleaning perspective because cleaning of the top layers of entanglement are performed for each revolution of the brush roll, i.e. the more the layers of entangled articles at a specific segment the longer the total cleaning time. Therefore, the brush roll cleaning time is dependent on the maximum layers of entanglement at one specific segment of the brush roll. Therefore it is more beneficial if the total entanglement is spread out along the length of the brush roll. As seen from the FIGS. 4*a-d*, the rotatable member 3 comprises radial ribs 9 arranged perpendicular to the longitudinal axis 10 of the rotatable member 3. The radial ribs 9 extend from the rotatable member 3 to the projecting member creating multiple pockets 11 along the rotatable member 3. The multiple pockets 11 hinder entangled hairs etc. from wandering towards the middle segment. Thereby, a greater distribution of the entangled articles along the length of the brush roll is achieved, and the total brush roll cleaning time is reduced. Each pocket 11 catches and hinder particles like hair from wandering along the length of the brush roll.

Figure 5:
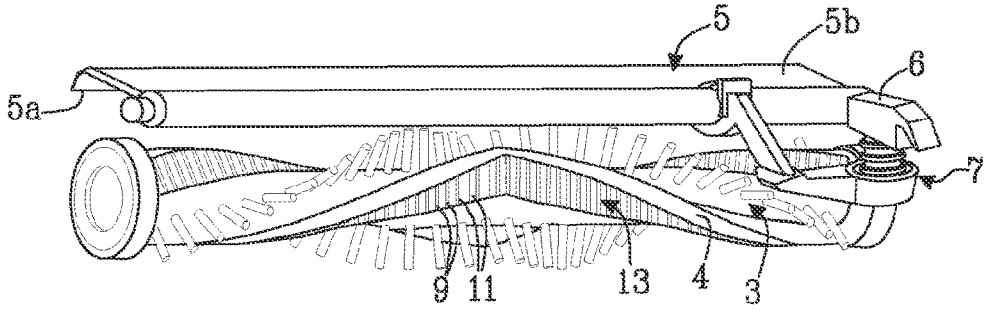
FIG. 5 illustrates a push button and a linking mechanism connected to the cleaning arrangement according to an embodiment.

FIG. 5 illustrates the push button 6 and the linking mechanism 7 connected to the cleaning arrangement according to an embodiment. The cleaning member 5 is moved from the resting position to the cleaning position by applying a pressing force to a push button 6 provided on the nozzle 1 at a surface turned towards a user. The cleaning member 5 is connected via a linking mechanism 7 shaft to the push button 6 on the nozzle 1.

Figure 6A:
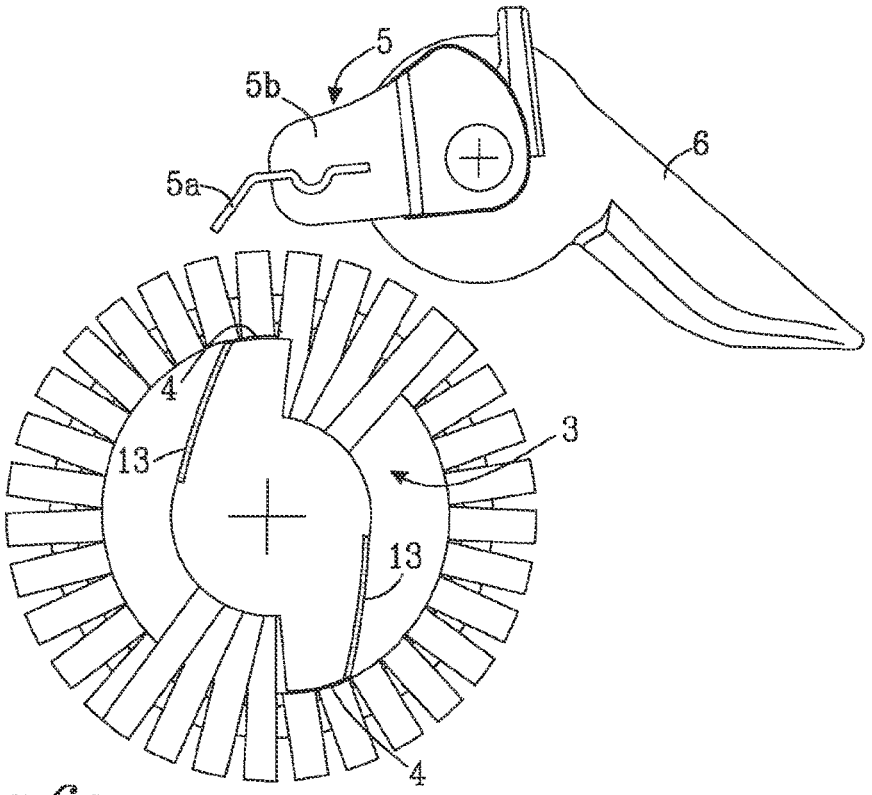
FIGS. 6*a* and 6*b* is a side view of the cleaning arrangement and the brush roll according to an embodiment.
Figure 6B:
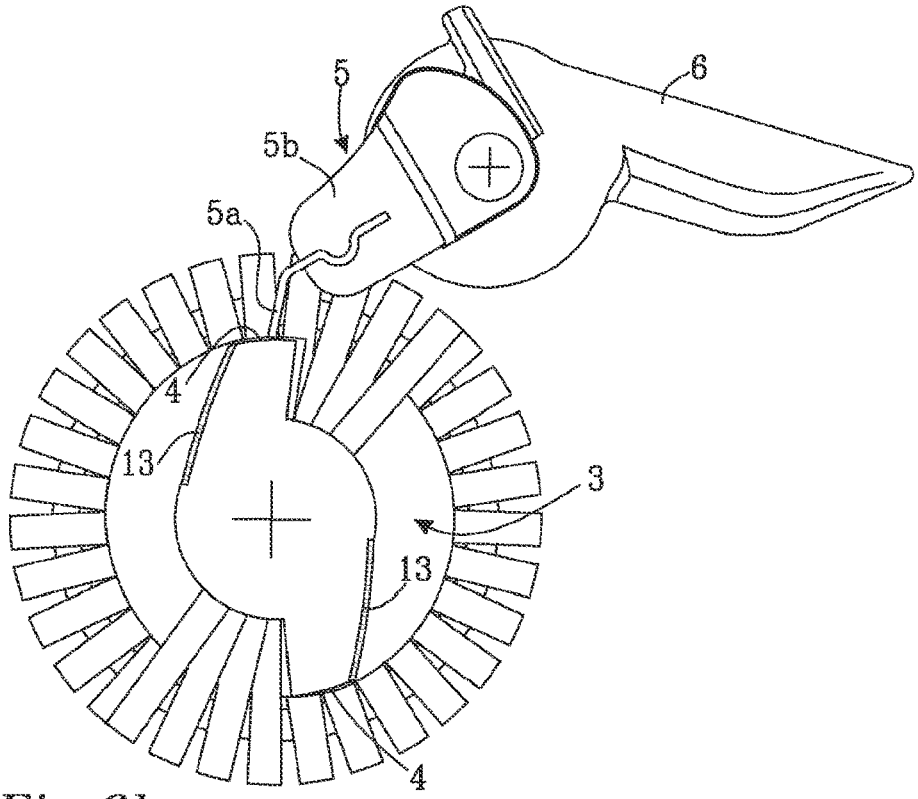

FIGS. 6*a* and 6*b* is a detailed side view of the cleaning arrangement and the brush roll according to an embodiment. In FIG. 6*a*, the cleaning member 5 is shown in a resting position. There is no contact between the resilient sheet member 5*a* and any parts of the rotating brush roll. In FIG. 6*b*, the cleaning member has been pivoted into a cleaning position. The resilient sheet member 5*a* is brought in the near vicinity of the rotating brush roll and a resilient contact is obtained between the resilient sheet member 5*a* and a support surface 4. The sharp edge of the resilient sheet member 5*a* will remove any articles entangled to the brush roll.

Figure 7A:
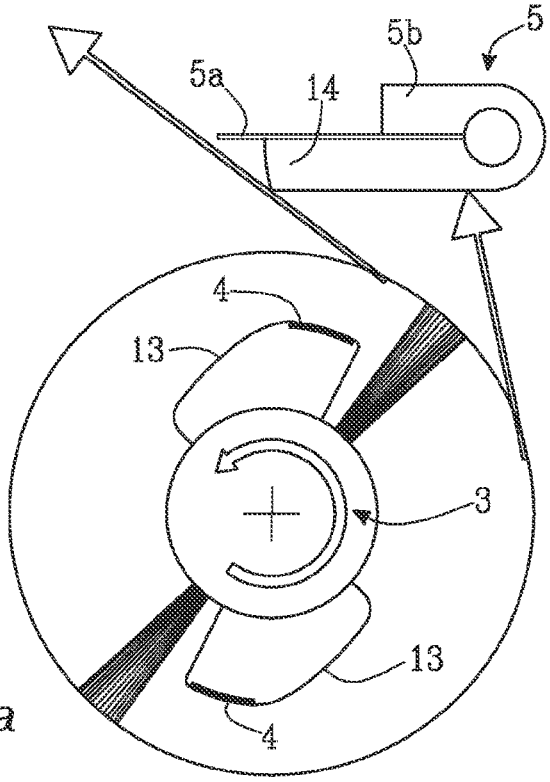
FIGS. 7*a* and 7*b* illustrates alternative arrangements in order to protect the cleaning arrangement and the brush roll with bristles from unnecessary wear when the cleaning arrangement is in a resting mode, and FIG. 8 show details of the cleaning arrangement according to an embodiment.
Figure 7B:
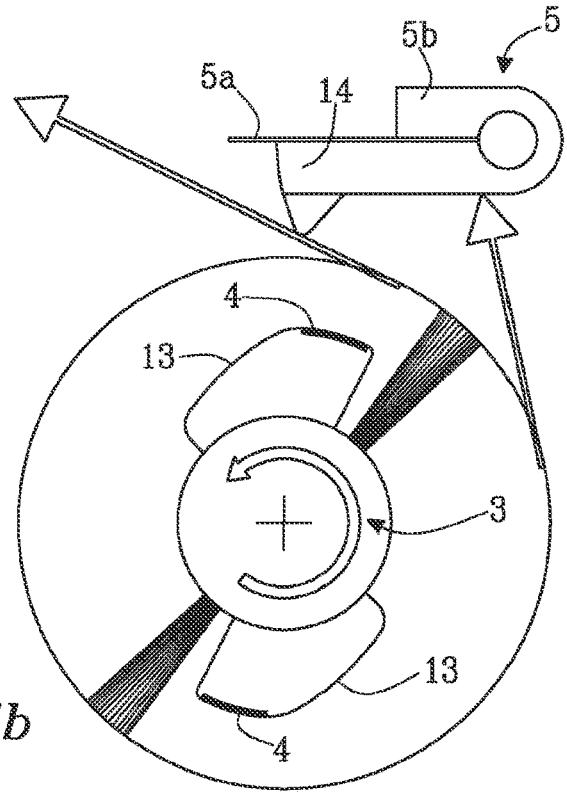

FIGS. 7*a* and 7*b* illustrates alternative arrangements in order to protect the brush roll from unnecessary wear when the cleaning arrangement is in a resting mode. The cleaning member 5 is designed to be protected from wear during normal vacuum cleaning, and also to help in minimizing the wear of the bristles during brush roll cleaning. Hard particles like small stones or the like cleaned up by the rotatable member 3 may contribute to wear of the cleaning member 5, and especially of the sharp edge. As seen in the drawings particles are prevented from contact with the cleaning member 5 by a protruding part 8 arranged faced to the rotatable member 3. Further, the protruding part 8 delimits wear of bristles on the brush roll due to contact between the bristles and the edge of the cleaning member 5. The bristles will first be in contact with the protruding part 8. Thereby, the bristles are bent before they get in contact with the edge and wear of the bristles are limited.

Figure 8:
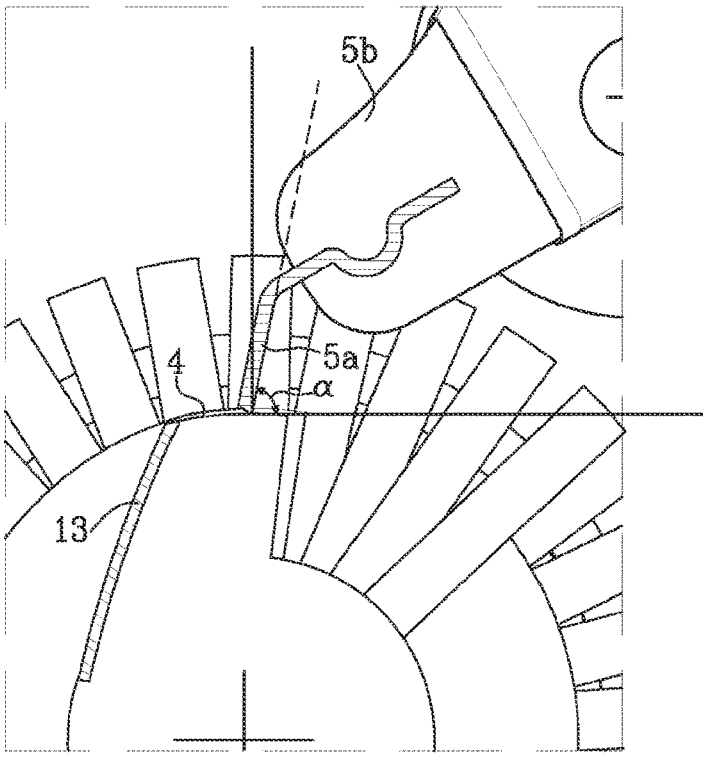

FIG. 8 show details of the cleaning arrangement according to an embodiment. The resilient sheet member 5*a* of the cleaning member 5 when positioned in a cleaning position meets a tangent of a segment of the support surface 4 at an angle α which is in the range of 40°-90°.

When in use, the cleaning arrangement works as follows. During brush roll cleaning the cleaning member 5 will interact and apply pressure on a support surface 4 provided on a rotatable brush roll provided in the nozzle 1 of a vacuum cleaner. During the cleaning process, the motor fan of the vacuum cleaner is also turned on. The support surface 4 is the only area of the brush roll, apart from the bristles, that will be in contact with the cleaning member 5 during a cleaning process. For a full revolution of the brush roll, the entire support surface 4 will have been in contact with the cleaning member 5 and therefore will any entangled article be exposed to the cleaning interaction in between these parts. Entangled articles will get torn into smaller pieces by the tearing, or friction, caused by the cleaning member 5 at the support surface. These torn articles may be separated from the brush roll by the airflow of the vacuum cleaner in combination with centrifugal force due to the rotational movement of the brush roll and will end up in the dust container or dust bag of the vacuum cleaner. The bristles of the brush roll will flex below the cleaning member 5 during brush roll cleaning. Since it is the pressure that the cleaning member 5 applies on the surface of the support surface 4 that generates the majority of the tearing friction, the bristles will not be exposed to the same wear as the entangled articles. Further, since the resilient sheet member 5*a* is able to flex, a consistent interaction in between the resilient sheet member 5*a* and the support surface 4 during brush roll cleaning is achieved, which in turn will lower the tolerances. The brush roll cleaning performance is dependent on the rotational speed of the brush roll; the higher speed, the faster brush roll cleaning. Further on the speed is closely related to the torque; an increased torque will decrease the speed. It is therefore important to find a state were the applied torque is high enough for efficient brush roll cleaning whilst at the same time low enough to not decrease the speed too much.

The invention claimed is:

1. A nozzle for a vacuum cleaner, the nozzle comprising a rotatable member for picking up particles from a surface to be cleaned, the rotatable member being arranged to rotate around a longitudinal axis; and a cleaning arrangement for removing articles entangled on the rotatable member, wherein the cleaning arrangement comprises:

at least one support surface provided on at least one radially projecting member of the rotatable member, and at least one cleaning member being movable between a resting position in which the cleaning member is arranged at a distance from the support surface and at least one cleaning position in the vicinity of the rotatable member in which the cleaning member, during rotation of the rotatable member, co-operates with at least one segment of the support surface to remove entangled articles from the rotatable member;

wherein the at least one support surface comprises at least a first segment and a second segment, wherein the first segment is arranged at a first radius in relation to the longitudinal axis, the second segment is arranged at a second radius in relation to the longitudinal axis, and the second radius is different from the first radius; and wherein the respective radiuses of the segments are gradually changed whereby the segments form a continuous support surface.

2. The nozzle according to claim 1, wherein the cleaning member comprises a resilient sheet member capable of providing a resilient contact with at least one segment of the at least one support surface in the at least one cleaning position during rotation of the rotatable member.

3. The nozzle according claim 2, wherein the cleaning member comprises a longitudinal bar holding the resilient sheet member, the longitudinal bar being arranged along the longitudinal axis of the rotatable member.

4. The nozzle according to claim 2, wherein the resilient sheet member of the cleaning member in the at least one cleaning position meets a tangent of the at least one segment of the at least one support surface at an angle α which is in the range of 40°-90°.

5. The nozzle according to claim 2, wherein the resilient sheet member has a thickness in the range of 0.2-0.8 mm.

6. The nozzle according to claim 1, wherein the at least one radially projecting member is helically arranged along a longitudinal axis of the rotatable member.

7. The nozzle according to claim 1, wherein one single radially projecting member is helically arranged along a longitudinal axis of the rotatable member.

8. The nozzle according to claim 1, wherein a plurality of radially projecting members is helically arranged along a longitudinal axis of the rotatable member.

9. The nozzle according to claim 3, wherein the cleaning member is pivotally arranged via the longitudinal bar above the rotatable member such that the cleaning member is pivoted from the resting position above the rotatable member to the at least one cleaning position.

10. The nozzle according to claim 1, wherein the cleaning member is moved from the resting position to the at least one cleaning position by applying a pressing force to a push button provided on the nozzle at a surface facing a user.

11. The nozzle according to claim 10, wherein the cleaning member is connected via a linking mechanism to the push button on the nozzle.

12. The nozzle according to claim 1, wherein at least one protruding part is arranged on the nozzle at a surface facing the surface to be cleaned.

13. The nozzle according to claim 1, wherein the rotatable member comprises radial ribs arranged perpendicular to the longitudinal axis of the rotatable member.

14. The nozzle according to claim 13, wherein the radial ribs extend from the rotatable member to the at least one projecting member creating multiple pockets along the rotatable member.

15. The nozzle according to claim 1, wherein the at least one support surface comprises a plurality of support surfaces arranged on a plurality of respective radially projecting members.

16. The nozzle according to claim 1, further comprising a nozzle cover that at least partly is made of transparent material such that the rotatable member may be visible through the nozzle cover.

17. The nozzle according to claim 2, wherein the resilient sheet member comprises a sheet of material having:

a blade portion that contacts the at least one segment of the at least one support surface in the at least one cleaning position during rotation of the rotatable member;

a mounting portion that is connected to a bar that movably mounts the resilient sheet member to the nozzle; and a bent portion that joins the blade portion to the mounting portion.

18. The nozzle according to claim 17, wherein the bent portion comprises a bend that is oriented parallel to the longitudinal axis.

19. The nozzle according to claim 2, wherein the resilient sheet member comprises a spring steel sheet.

20. The nozzle according to claim 19, wherein the spring steel sheet comprises a blade formed by stamping the sheet or machining the sheet.

21. A nozzle for a vacuum cleaner, the nozzle comprising a rotatable member for picking up particles from a surface to be cleaned, the rotatable member being arranged to rotate around a longitudinal axis; and a cleaning arrangement for removing articles entangled on the rotatable member, wherein the cleaning arrangement comprises:

at least one support surface provided on at least one radially projecting member of the rotatable member, and at least one cleaning member being movable between a resting position in which the cleaning member is arranged at a distance from the support surface and at least one cleaning position in the vicinity of the rotatable member in which the cleaning member, during rotation of the rotatable member, co-operates with at least one segment of the support surface to remove entangled articles from the rotatable member;

wherein the at least one support surface comprises at least a first segment and a second segment, wherein the first segment is arranged at a first radius in relation to the longitudinal axis, the second segment is arranged at a second radius in relation to the longitudinal axis, and the second radius is different from the first radius; and wherein the rotatable member comprises radial ribs arranged perpendicular to the longitudinal axis of the rotatable member.

22. The nozzle according to claim 21, wherein the radial ribs extend from the rotatable member to the at least one projecting member creating multiple pockets along the rotatable member.

* * * * *